US006431295B1

(12) United States Patent
Kleine et al.

(10) Patent No.: US 6,431,295 B1
(45) Date of Patent: Aug. 13, 2002

(54) ROCK DRILL

(75) Inventors: Werner Kleine, Achim; Hans-Werner Bongers-Ambrosius, Munich, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/656,871

(22) Filed: Sep. 7, 2000

(30) Foreign Application Priority Data

Sep. 9, 1999 (DE) ..... 199 42 987

(51) Int. Cl.[7] ..... E21B 10/44; E21B 10/38
(52) U.S. Cl. ..... 175/415; 175/420.1; 175/427
(58) Field of Search ..... 175/420.1, 427, 175/426, 415, 414, 394

(56) References Cited

U.S. PATENT DOCUMENTS

| | | | | |
|---|---|---|---|---|
| 4,903,787 A | * | 2/1990 | Mose et al. | 175/415 |
| 5,265,688 A | * | 11/1993 | Rumpp et al. | 175/394 |
| 5,779,403 A | * | 7/1998 | Kleine et al. | 408/230 |
| 5,836,410 A | * | 11/1998 | Kleine | 175/415 |
| 6,116,361 A | * | 9/2000 | Kleine et al. | 175/415 |
| 6,283,232 B1 | * | 9/2001 | Batliner et al. | 175/415 |

FOREIGN PATENT DOCUMENTS

| | | |
|---|---|---|
| DE | 3020284 | 12/1981 |
| DE | 9537900 | 4/1997 |
| DE | 9653155 | 7/1998 |
| EP | 0778391 | 10/1996 |
| EP | 0607958 | 8/1998 |

* cited by examiner

*Primary Examiner*—Hoang Dang
(74) *Attorney, Agent, or Firm*—Sidley Austin Brown & Wood, LLP

(57) ABSTRACT

A drill including a stem (2) having at least two discharge grooves (3,4) for discharging drilling dust and helically circumscribing the stem (2), a drill head (5) provided at an of the stem (2) opposite the end provided with the shank and having a plurality of bits (7–9), which are formed of hard metal and project radially beyond the drill head (5), with the drill head having a plurality of drilling dust grooves (10–12) which separate the bits and number of which exceeds a number of the discharge grooves (3,4), with at least one pair of the drilling dust grooves (10,12) passing into a common discharge groove (4), and with the drill further having a helical groove section (13) forming a common transitional region between the at least one pair of the drilling dust grooves (10,12) and the common discharge groove and the passing cross-section of which is smaller than the passing cross-section of the common discharge groove.

11 Claims, 2 Drawing Sheets

ROCK DRILL

BACKGROUND OF THE INVENTION

1. Field of the Invention

The present invention relates to a drill including a stem having a shank at one of its ends and at least two discharge grooves for discharging drilling dust and helically circumscribing the stem, and a drill head provided at an end of the stem opposite the end provided with the shank, with the drill head being provided with bits, which are formed of hard metal and project radically beyond the drill head, and with a plurality of drilling dust grooves which are located between the bits and the number of which exceeds the number of the discharge grooves, with at least one pair of the drilling dust grooves passing into a common discharge groove.

2. Description of the Prior Art

For forming bores in concrete, brickwork, stone and the like, drills having drill heads with bits formed of a cutting material, preferably, hard material, are used. The drills are usually inserted in a hand-held drilling tool which in addition to a rotary drive includes a hammer mechanism for imparting axial blows to the drill. The axial blows are imparted to a shank provided at the end of the drill stem and which is received in the drilling tool chuck, and are transmitted through the stem and drill head to a structural component in which a bore is drilled. In this way, the structural component is shaved, chiseled, and is subjected to a treatment which is accompanied by chip removal. The drill, in addition to meeting requirements with respect to drill feed and an necessary expenditure of force, should have as long as possible service life.

Prior art discloses a number of drills which are characterized, under normal operational conditions, by satisfactory feed characteristics and force expenditures. Also under normal operational conditions, their service life is also acceptable. Such a drill is disclosed, e.g., in U.S. Pat. No. 4,903,787. The drill has a stem with a shank adapted to be received in a hand-held tool, and a drill head provided at a stem end opposite the shank. The drill head has four bits which are provided in a star-shaped insert formed of a hard material. The bits are separated by drilling dust grooves which open in two discharge grooves for discharging the drilling dust and which helically circumscribe the stem. The known drill is capable of meeting the necessary requirements, in particular of a professional user, at small and medium bore diameters. However, for the use of the drill for drilling large diameter bore, it needs improvement. In particular, during drilling a bore in a reinforced concrete, the drill can encounter a reinforcing metal and be hooked over the reinforcing metal. The danger of a drill head being hooked over the reinforcing metal increases with an increase of a diameter of a to-be-drilled bore.

Accordingly, an object of the present invention is to eliminate the drawbacks of the prior art drills and provide a drill with which a danger of the drill being hooked during drilling bores in a reinforced concrete is reduced even during drilling bores having a large diameter.

Another object of the present invention is to provide a drill having good feed characteristics at a reduced expenditure of force, and having an increased service life.

SUMMARY OF THE INVENTION

These and other objects of the present invention, which will become apparent hereinafter, are achieved by providing a drill, in particular a rock drill including a stem having a shank at one of its ends and at least two discharge grooves for discharging drilling dust and helically circumscribing the stem. At its opposite end, the stem is provided with a drill head having bits which are formed of hard metal and project radically beyond the drill head. A plurality of drilling dust grooves separates the bits, and their number exceeds a number of the discharge grooves, into which they open. At least one pair of the drilling dust grooves passes into a common discharge groove. A helical groove section forms a common transitional region between the at least one pair of the drilling dust grooves and the common discharge groove. The helical groove section has a passing cross-section which is smaller than the passing cross-section of the common discharge groove.

The helical groove section which, according to the present invention, connects two drilling dust grooves opening in a common discharge groove counteracts the tendency of the drilling head to hook over the reinforcing metal. In a drill, e.g., with three bits and three drilling dust grooves separating the bits, one of the drilling dust groove opens directly into an associated discharge groove. In the conventional drills, the bit which, viewing in a rotational direction, is located immediately in front of a drilling dust groove, which opens directly into a discharge groove, is supported axially only by a small amount of the drill head material as a relatively large width of the helical groove section occupies a relatively large portion of the axial width of the discharge groove. According to the invention, the helical groove section has a noticeably smaller passing cross-section. Therefore, a longer web remains under the circumferential bit which forms a head side limiting shoulder of the helical groove section. This advantageously favors the drill advance. Upon encountering a reinforcing metal, in particular during drilling the metal, the danger of hooking of the shorter material web behind the metal is reduced.

The smaller passing cross-section of the helical groove section is preferably achieved by providing, at a same root diameter of the stem a helical groove section having a smaller opening width than the opening width of the common charge groove measured over the drill circumference. The root diameter here is the stem diameter at the base of the common discharge groove. Providing the same root diameter reduces the weakness of the head region of the stem to a most possible extent.

In order to further improve the guide characteristics of the drill in a bore and to increase resistance to hooking, the limiting shoulder of the helical groove section, which is located closer to the shank, gradually passes into a limiting shoulder of the common discharge groove which is likewise located closer to the shank. In this way, the discrete edge-like transitional regions, which can lead to hooking, in particular upon encountering a reinforcing metal, are eliminated.

When reducing the passing cross-section of the helical groove section, care should be taken not to make it very small as the drillings, which are produced by the associated bit, need be removed and, thus, should be able to pass through the helical groove section. Therefore, advantageously, the passing cross-section of the helical groove section amounts to from about 30% to about 20% of the common discharge groove.

For a rapid discharge of produced drilling, it is advantageous when with an uneven number of the drilling dust grooves, the discharge grooves have different passing cross-sections, with the common discharge groove having a larger passing cross-section. The common discharge groove should provide for removal of drillings produced by two bits. This is taken into account by forming the common discharge groove with a larger passing cross-section.

For a good drill advance with a reduced tendency to hooking upon an encounter with reinforcing metal, the drill according to the present invention is provided with three bits, with each two adjacent bits being separated by a drilling dust groove.

According to a further embodiment of the present invention, the drill can have an even number of bits, e.g., four, which are separated by respective drilling dust grooves. The drilling dust grooves open pairwise in respective discharge grooves. In this embodiment, the drill head is formed symmetrical to a most possible extent which is favorable for a uniform loading of the drill head. In this embodiment, the helical groove sections, which form respective transitional regions between respective pairs of the drilling dust grooves and respective common discharge grooves, have the same passing cross-section.

When in the drill according to the present invention with an uneven number of bits, the helical groove section ends, in axial direction, beneath sections of the drill head located under at least two of the bits and is limited by shoulders which are located at the same cross-section of the drill, the drill head can have a smaller height than the conventional drill heads. With an even number of bits, advantageously, the axial supports of all of the bits have substantially the same length.

From the manufacturing point of view, it is advantageous when the helical groove section and the drilling dust grooves have at least partially the same cross sectional profile.

The bits can be provided on plate-shaped inserts formed of hard metal and insertable in slot-like recesses formed in the end surface of the drill head and be, be, e.g., soldered thereto. In accordance with an alternative embodiment of the present invention, the entire drill head can be formed of hard metal. The hard metal drill head can, e.g., be connected with the stem by friction welding or otherwise be fixedly connected with the stem. The advantage of using a hard metal drill head consists in that in can have almost any arbitrary shape, and its mounting on the stem is made easier.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 3:
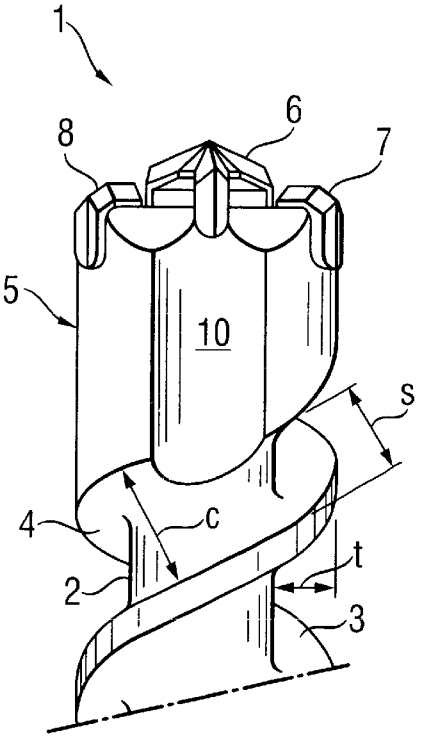
FIG. 3 a side view of the rock drill in the direction of arrow Z in FIG. 1.

A rock drill 1 according to the present invention, which is shown in FIGS. 1–5 in which the same elements are designated with the same reference numerals, includes a stem 2 the rear end of which (not shown) is formed as a shank receivable in a check of a drilling tool. At the opposite end of the stem 2, the drill 1 is provided with a drilling head 5 equipped with bits 6–9 formed of a hard metal. The bits 6–9 extend beyond the drilling head 5 both radially and axially. In the embodiment of the rock drill 1 shown in the drawings, the rock drill 1 has an essentially star-shaped, three-prong central bit 6 and three circumferential bits 7–9 which are arranged in the circumferential region of the drilling head 5 and are angularly spaced from each other by an angle of about 120°. Between the circumferential bits 7–9, there are provided three drilling dust grooves 10–12 extending substantially axially. The first drilling dust groove 10 is located between the circumferential bits 7 and 8 and extends in the rotational direction of the drill 1 which is shown with arrow R. The second drilling dust groove 11 is arranged between the circumferential bits 8 and 9. The third drilling dust groove 12 lies between the circumferential bits 7 and 9. The drilling dust grooves 10–12 are associated, respectively, with the circumferential bits 8, 9 and 7. The width of the drilling dust grooves 10–12, measured along the circumference of the drilling head 5 is designated with a reference character b. The drilling dust grooves 10–12 can have different width b. In the embodiment shown in the drawings, however, all of the drilling dust grooves 10–12 have the same width. Arrows Y, Z, X and W show different side view of the drill 1 which are shown in FIGS. 2–5, respectively.

Figure 2:
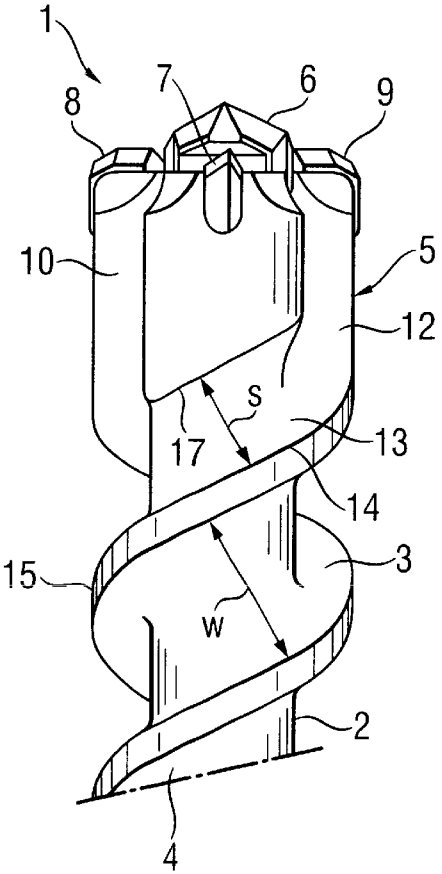
FIG. 2 a side view of the rock drill in the direction of arrow Y in FIG. 1.
Figure 1:
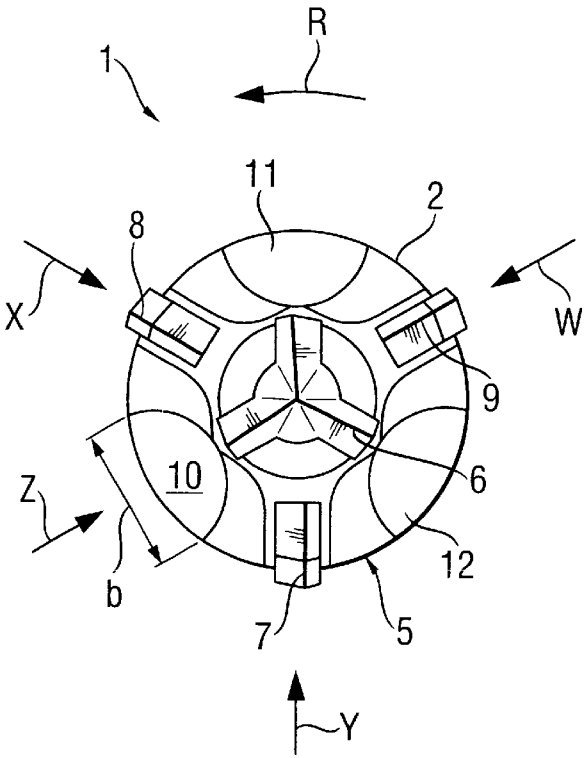
FIG. 1 a plan view of a drilling head of a rock drill according to the present invention.

In FIG. 2, the drill and all of its components have the same reference numerals as similar components shown in FIG. 1. As shown in FIG. 2, the drilling dust grooves 10 and 12, which are associated with the circumferential bits 8 and 9, are connected with a helical groove section 13. The helical groove section 13 opens, at its end remote from the viewer, into a discharge groove 4 which circumscribes the stem 2 as a helice and forms a common extension of the drilling dust grooves 10 and 12. In FIG. 2, the common discharge groove 4 is located beneath a further discharge Groove 3. The two discharge grooves 3, 4 surround the stem 2 as helices and alternatively follow one another in the axial direction. The passing cross-section and the opening width of the discharge grooves 3, 4 can, e.g. be the same. In accordance with an embodiment of the invention, there can be provided a common discharge groove with a larger passing cross-section and an opening width than the second discharge groove. In FIG. 2, the opening width of the second discharge groove 3 is designated with a letter w. The helical groove section 13 has a smaller passing cross-section than the second discharge groove 3. In particular, with the root diameter of the stem 2 remaining the same to a most possible extent, the opening width s of the helical groove section 13 is smaller than the opening width w of the second discharge groove 3. The helical groove section 13 is limited by two shoulders 14 and 17. The shoulder 14, which is located more closely to the shank, gradually passes into the shoulder 15 of the common discharge groove 4.

Figure 4:
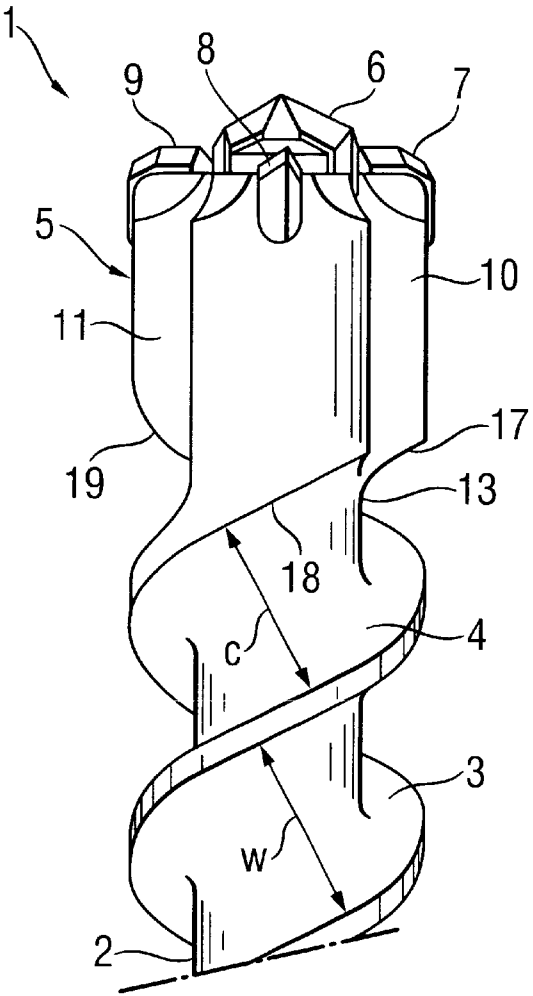
FIG. 4. a side view of the rock drill in the direction of arrow X in FIG. 1.

The different opening widths s and c of the helical groove section 13 and the discharge groove 4 can be particularly clearly seen in the view in the direction of arrow X in FIG. 1 which is shown in FIG. 4. In the view shown in FIG. 4, the passing cross-section of the helical groove section 13 amounts to from about 30% to about 70% of the passing cross-section of the discharge groove 4. The helical groove section 13 has a depth t, which can clearly be seen in FIG. 3, a ratio of which to the drill nominal diameter amounts to from about ⅙ to about ⅓.

In FIG. 4, the bits, which extends radially beyond the drill head 5, are again designated with reference numerals 6–9.

Figure 5:
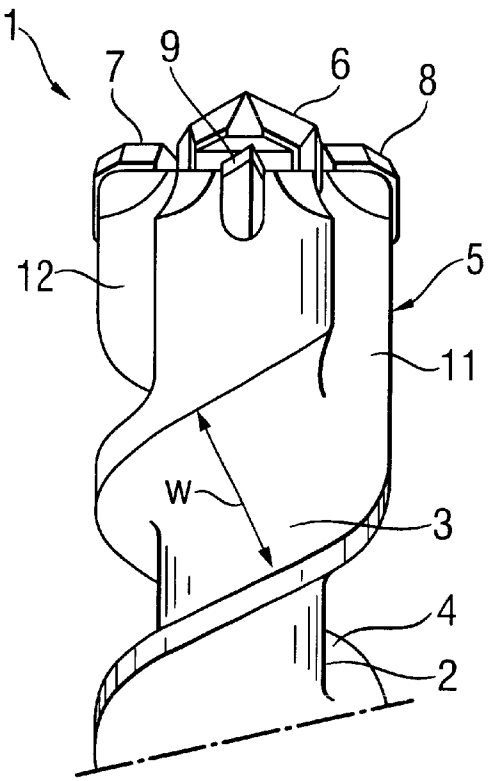
FIG. 5 a side view of the rock drill in the direction of arrow W in FIG. 1.

FIG. 4 shows both axial drilling dust grooves 10 and 11. The drilling dust groove 10, which is associated with the circumferential bit 8, opens into the helical groove section 13 which passes into the common groove 4, as discussed above. The drilling dust groove 11, which is associated with the circumferential bit 9 opens, at its end remote from the viewer, into the second discharge groove 3. The opening widths c and w of the discharge grooves 3, 4, respectively, are substantially the same. As can be seen in FIG. 4, the helical groove section 13 ends beneath sections of the bore head 5 located under the circumferential bits 7–9 arranged at the height of the same cross-section of the drill 1. FIG. 5 shows a side view in the direction of arrow w in FIG. 1. This view shows the course of the drilling dust groove 11 associated with the circumferential bit 9 and opening directly into the second discharge groove 3. The common discharge groove 4, into which the drilling dust groove 12 associated with the circumferential bit 7 and the drilling dust groove 10 associated with the circumferential bit 8 open, starts at a side of the drill remote from viewer, and is shown beneath the second discharge groove 3.

The present invention has been explained with a reference to an embodiment of a drill having a central bit and three circumferential bits. In an alternative embodiment of the invention, the hard metal bits can be provided on a star-shaped three-prong insert secured in the end surface of the drill stem. The bits extend from a peak in the center toward the circumference of the drill head, sloping toward the drill circumference and projecting beyond it. The drilling dust grooves are provided between the bits. With three drilling dust grooves, two of the grooves open into a helical groove section. The third drilling dust groove opens into a discharge groove helically circumscribing the drill stem. Also, four hard metal bit can be provided. In this case each two respective drilling dust grooves open into a respective helical groove section which passes into one of two discharge grooves provided on the drill stem. In accordance with a further embodiment of the invention, the entire drill head can be formed of hard metal and be connected with the stem, e.g. by welding. Forming the drill head as a single part has certain advantages. It simplifies shaping or formation of the drill head, and the drill head can be relatively easy secured to the stem.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A drill, comprising a stem (2) having a shank at one end thereof and at last two discharge grooves (3,4) for discharging drilling dust and helically circumscribing the stem (2); a drill head (5) provided at an end of the stem (2) opposite the end provided with the shank, the drill head (5) being provided with bits (7–9), which are formed of hard metal and project radially beyond the drill head (50), and with a plurality of drilling dust grooves (10–12) which are located between the bits and the number of which exceeds a number of the discharge grooves (3,4) with at least one pair of the drilling dust grooves (10, 12) passing into a common discharge groove (4); and a helical groove section (13) forming a common transitional region between the at least one pair of the drilling dust grooves (10,12) and the common discharge groove (4) and having a passing cross-section smaller than a passing cross-section of the common discharge groove (4), wherein with an uneven number of the drilling dust grooves (10–12), the discharge grooves (3,4) have different passing cross-sections, with the common discharge groove having a larger passing cross-section.

2. A drill, comprising a stem (2) having a shank at one end thereof and at last two discharge grooves (3,4) for discharging drilling dust and helically circumscribing the stem (2); a drill head (5) provided at an end of the stem (2) opposite the end provided with the shank, the drill head (5) being provided with bits (7–9), which are formed of hard metal and project radially beyond the drill head (5), and with a plurality of drilling dust grooves (10–12) which are located between the bits and the number of which exceeds a number of the discharge grooves (3,4) with at least one pair of the drilling dust grooves (10, 12) passing into a common discharge groove (4); and a helical groove section (13) forming a common transitional region between the at least one pair of the drilling dust grooves (10,12) and the common discharge groove (4) and having a passing cross-section smaller than a passing cross-section of the common discharge groove (4), wherein the drill head (5) has three bits (7–9), with each two adjacent bits being separated by a respective drilling dust groove (10–12).

3. A drill according to claim 2, wherein the helical groove section (13) has an opening width (9), (5) smaller than an opening width (c) of the common discharge groove (4) measured on a stem circumference.

4. A drill according to claim 2, wherein a limiting shoulder (14) of the helical groove section (13), which is located closer to the shank, gradually passes into a limiting shoulder (15) of the common discharge groove (4), which likewise is located closer to the shank.

5. A drill according to claim 2, wherein the passing cross-section of the helical groove section (13) amounts to from about 30% to about 70% of the passing cross-section of the common discharge groove (4).

6. A drill, comprising a stem (2) having a shank at one end thereof and at last two discharge grooves (3,4) for discharging drilling dust and helically circumscribing the stem (2); a drill head (5) provided at an end of the stem (2) opposite the end provided with the shank, the drill head (5) being provided with bits (7–9), which are formed of hard metal and project radially beyond the drill head (5), and with a plurality of drilling dust grooves (10–12) which are located between the bits and the number of which exceeds a number of the discharge grooves (3,4) with at least one pair of the drilling dust grooves (10, 12) passing into a common discharge groove (4); and a helical groove section (13) forming a common transitional region between the at least one pair of the drilling dust grooves (10,12) and the common discharge groove (4) and having a passing cross-section smaller than a passing cross-section of the common discharge groove (4), wherein with an uneven number of bits (7–9), the helical groove section (13) ends, in an axial direction beneath sections of the drill head (5) located under at least two of the bits (8,9) and is limited by shoulders (18, 19) which are located at the same cross-section of the drill (1).

7. A drill, comprising a stem (2) having a shank at one end thereof and at last two discharge grooves (3,4) for discharging drilling dust and helically circumscribing the stem (2); a drill head (5) provided at an end of the stem (2) opposite the end provided with the shank, the drill head (5) being provided with bits (7–9), which are formed of hard metal and project radially beyond the drill head (5), and with a plurality of drilling dust grooves (10–12) which are located between the bits and the number of which exceeds a number of the discharge grooves (3,4) with at least one pair of the drilling dust grooves (10, 12) passing into a common discharge groove (4); and a helical groove section (13) forming a common transitional region between the at least one pair of the drilling dust grooves (10,12) and the common discharge groove (4) and having a passing cross-section smaller than a passing cross-section of the common discharge groove (4), wherein the helical groove section and the drilling dust groove have at least partially a same cross-section.

8. A drill according to claim 7, wherein the drill head (5) has an even number of bits which are separated by an even number of the drilling dust grooves, respectively, which open pairwise in the common discharge grooves, respectively.

9. A drill according to claim 8, wherein the helical groove sections, which form respective transitional regions between respective pairs of the drilling dust grooves and respective common discharge grooves, have a same passing cross-section.

10. A drill according to claim 9, wherein the helical groove sections end, in an axial direction, beneath respective sections of the bore head located under respective pairs of bits, and are limited by a respective pair of shoulders, and wherein all of the drilling dust groove-limiting shoulders are located at a same cross-section of the drill.

11. A drill according to claim 8, wherein drill head is formed of a hard metal.

* * * * *